United States Patent [19]

Weber

[11] Patent Number: 5,056,287

[45] Date of Patent: Oct. 15, 1991

[54] PANEL MOUNTING CONSTRUCTION AND METHOD OF USE

[76] Inventor: Michael Weber, 1633 Alpine Dr., R.D. #1, Pen Argyl, Pa. 18072

[21] Appl. No.: 575,298

[22] Filed: Aug. 30, 1990

[51] Int. Cl.[5] ..... E04C 1/40

[52] U.S. Cl. ..... 52/511; 52/761; 52/508; 52/488; 52/764

[58] Field of Search ..... 52/488, 489, 490, 474, 52/476, 482, 483, 484, 481, 479, 507, 511, 508, 764, 506, 38, 39, 761, 775

[56] References Cited

U.S. PATENT DOCUMENTS

| | | | |
|---|---|---|---|
| 1,854,438 | 4/1932 | Wray | 52/508 X |
| 2,403,881 | 7/1946 | Tarbox | 52/489 |
| 3,163,266 | 1/1961 | Nelsson | 189/35 |
| 3,202,077 | 4/1963 | Lee | 98/40 |
| 3,232,021 | 3/1964 | Wilson | 52/507 |
| 3,296,751 | 12/1965 | Heirich | 52/38 |
| 3,683,101 | 8/1972 | Liberman | 52/39 X |
| 4,232,497 | 11/1980 | Meschnig | 52/506 |
| 4,7209,946 | 1/1988 | Pagliarello | 52/39 |

*Primary Examiner*—David A. Scherbel
*Assistant Examiner*—Creighton Smith
*Attorney, Agent, or Firm*—Eckert Seamans Cherin & Mellott

[57] ABSTRACT

The invention offers a suspended ceiling without an exposed framework. Lugs mounted on the back of the panel snap into a downward pointing "C" shaped channel which are mounted to the ceiling joists. This allows for ease of installation, removal for cleaning, and for easily changing the finish of the ceiling while maintaining a very short distance. Pre-spaced mounts for the channels ensure ease of installation with a minimum of work and skill and ensure a close fit of the panels. Optionally, an electrical system can be employed which places an outlet within easy reach of every ceiling panel. Panels equipped with an electrical device including lighting fixtures, fans, speakers, smoke alarms, or home security sensors can thus be easily installed and readily moved as the furnishings of the room change, with seasonal variations, or just to add a bit of variety.

Because no external frame is used, the invention also permits the use of non-rectangular panels which allows the user to custom design his ceiling pattern. The invention thus provides a highly versatile ceiling which is easy to install, maintain, and change.

20 Claims, 5 Drawing Sheets

PANEL MOUNTING CONSTRUCTION AND METHOD OF USE

BACKGROUND OF THE INVENTION

1. Field of the Invention

This invention relates to the field of tile mounting, especially for suspended or "drop" ceiling assemblies, and the method for using the same. In particular, the invention concerns a snap together ceiling panel mounting construction of rails, supports and tile panels, preferably including relocatable electrical fixtures.

2. Prior Art

Suspended ceilings are known in which ceiling panels are supported by various hooks, clips and horizontal flanges. In U.S. Pat. No. 3,232,021—Wilson, a ceiling structure comprising a round tube with a slot along its length is disclosed. The tube snaps over tabs on the end of a clip and neither the tube nor the clip is attached to a ceiling panel. Instead, the ceiling panels rest on flanges which extend horizontally from a vertical member attached to the tube.

U.S. Pat. No. 3,296,751—Heirich teaches a construction for suspending ceiling panels comprising an oval-shaped channel with an open bottom and a flat section inserted therethrough.

U.S. Pat. No. 4,720,946—Pagiliarello discloses a ceiling construction comprising rectangular channels having T-shaped members inserted therein. Additionally, inverted T-shaped members are employed to support the ceiling panels.

In U.S. Pat. No. 3,163,266—Nelsson, a ceiling construction comprising channel members and clips for joining the channel members together is taught.

U.S. Pat. No. 3,202,077—Lee discloses an expansion channel for a ceiling construction and a slotted tube. The slotted tube however, is solely for the purpose of ducting air and is not used for mounting ceiling panels.

The foregoing references teach various methods of suspending panels of ceilings from joists and similar building elements. Like most contemporary "drop" ceilings, the systems in the reference have several shortcomings. Most drop ceilings require alignment of a metal frame onto which the ceiling panels are set or from which they are hung. The frame typically requires complex assembly, measurement and alignment steps, and many people may be involved to hang the frame (and therefore the panels) correctly. The frames are also susceptible to bending and distortion during installation. Since the typical thin metal frame material can easily be creased permanently when bent, and since the frames are typically visible when installed, damaged segments of the frame must be removed and replaced, often requiring complete disassembly of the frame.

Frame type suspended ceilings have other shortcomings as well. First, during maintenance and cleaning, while the panels are being removed, sharp edges on the metal frames are exposed and may cause injury. When an overhead electrical device is required, such as a light or cooling fan, special support and wiring must be put in for the fixture and once installed, movement of the panel to another location is severely limited. In addition, metal frames may pose an electrical hazard should a live wire become exposed above the panels, which possibility is increased if the panels are intended to be removable and/or relocatable. It is possible that the entire frame could become electrified by contact with a loose conductor and could cause great harm by electrocution or falling to anyone attempting maintenance who happens to touch the frame, and may also pose a fire hazard. The possible damages such an occurrence may cause is increased due to the fact that access to the panels is usually gained while standing on something to give added height.

The size, shape, and color of the ceiling panels is also severely limited when a frame type suspension construction is used because the frames define openings for the panels. Panels must be approximately the same size and shape as the corresponding openings in the frame in order to be properly suspended. This means that panels are almost without exception rectangular. The frames are available in a very limited variety of colors (usually white, wood-tone or beige) and the panels usually match the frame color. Thus the consumer is limited as to the color of the ceiling panels unless the frame is painted which would require either overhead painting or disassembly of the frame system, both of which are large time consuming tasks.

The present invention revises the known suspended ceiling construction by using a different form of supporting framework, disposed behind the panels. Preferably plastic slotted pipes or the like are attached to the ceiling joists by connectors mounted at fixed spacing on furring rails. Lugs which are attached lengthwise to the backs of the ceiling panels are inserted into the slotted pipes, which are necessarily spaced accurately by the connectors on the furring rails. The preferred non-metal construction adds both a measure of safety from shock and freedom from the shortcomings associated with the metal framework. The non-metal construction resists damage during installation and needs no complicated measuring or assembly. It will not rot, rust or fade and has no sharp edges to injure maintenance workers. Additionally the panels, which may be nearly any shape or size, may be easily removed and finished on the ground.

The present invention also incorporates an integral electrical power distribution system which in the preferred embodiment provides a power outlet at each panel location, located at a standard position relative to the panels. Thus panels with electrical devices may be easily installed and easily moved to suit changes in decor, season, or the whim of the consumer.

The invention thus provides a versatile mounting system for ceiling panels as well as other forms of tiles, allowing a wide choice of panel type, dimensions and fixture location, while improving substantially the convenience of installation.

SUMMARY OF THE INVENTION

It is the object of the invention to provide a suspended type ceiling comprised of very few basic parts to provide a more generally applicable system than those taught in prior art, keeping costs at a minimum, and making installation and removal simple and less time consuming. The invention is readily installed by those without any special skills, requiring only a screwdriver for assembly.

It is another object of this invention to provide a ceiling system that is strong and rigid enough to support itself in all typical applications without coming apart unexpectedly, which is also suitable for close as well as long mount applications and wherein changes may be accomplished in room size, structure, arrangements, or decor, as well as quick, easy changes colors or patterns of ceiling tiles or in the location or arrangements of ceiling mounted electrical devices such as light fixtures, cooling fans and stereo speakers.

It is a further object of this invention to provide a ceiling system that is accommodating of structural irregularities in joists and the like, while resistant to damage caused by bending, denting or distorting during assembly and that will not rust, mildew, or discolor over time due to the excessive moisture or humidity.

It is also the object of this invention to provide a ceiling system that provides electrical connections for each panel location and is safer for the prevention of electrical hazards than conventional "drop" ceiling systems.

These and other objects are accomplished by constructing the invention extensively out of complementary self-spacing plastic parts which are relatively inexpensive, strong, and extremely resistant to damage and deterioration due to moisture. The invention provides snap-together construction including parallel spaced slotted pipe sections which are mounted to the joists via connector clips preferably disposed on furring strips or rails. The slotted pipe snaps over lugs on the tiles of approximately of the same diameter as the interior of the pipes. At least one of the lugs and the pipes are resilient, and preferably both. The pipes are affixed to the ceiling joists via mounting means and the lugs are affixed directly to the ceiling panels, thus making for a minimum of parts and extreme ease of assembly. By providing a spaced pipe to joist mounting means, no measuring or alignment is required.

An electrical system may be included. This system preferably provides an electrical outlet at every panel location, or at least at regularly spaced panel locations, and allows for simple relocation of panels equipped with electrical devices. In one embodiment, the simple snapping of the panel in place makes the electrical connection, while in another embodiment a short cord is attached to those panels with electrical devices. For certain panel-mounted fixtures such as ceiling fans, additional supporting means can be included to supplement the structural connection between the fixture and the joists.

BRIEF DESCRIPTION OF THE DRAWINGS

There are shown in the drawings the embodiments that are presently preferred. It should be understood that the invention is not limited to the arrangements and instrumentalities shown in the drawings and is capable of embodiment in other groupings of parts, subassemblies and the like.

DETAILED DESCRIPTION OF THE PREFERRED EMBODIMENTS

Figure 1A:
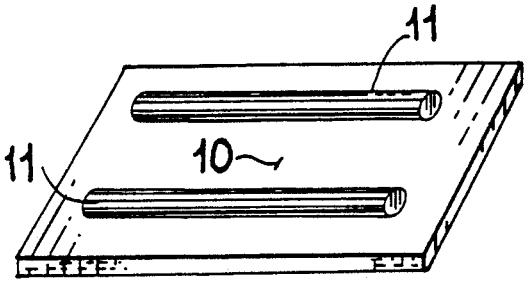
FIG. 1*a* is a perspective view of a ceiling panel according to the invention, with the elongated lugs attached for mounting.
Figure 1B:
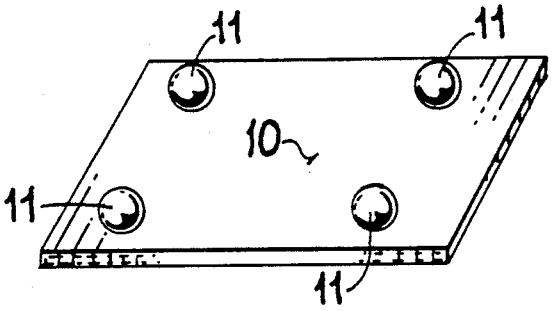
FIG. 1*b* is a perspective view of a ceiling panel according to the invention, with the spherical lugs attached for mounting.
Figure 2:
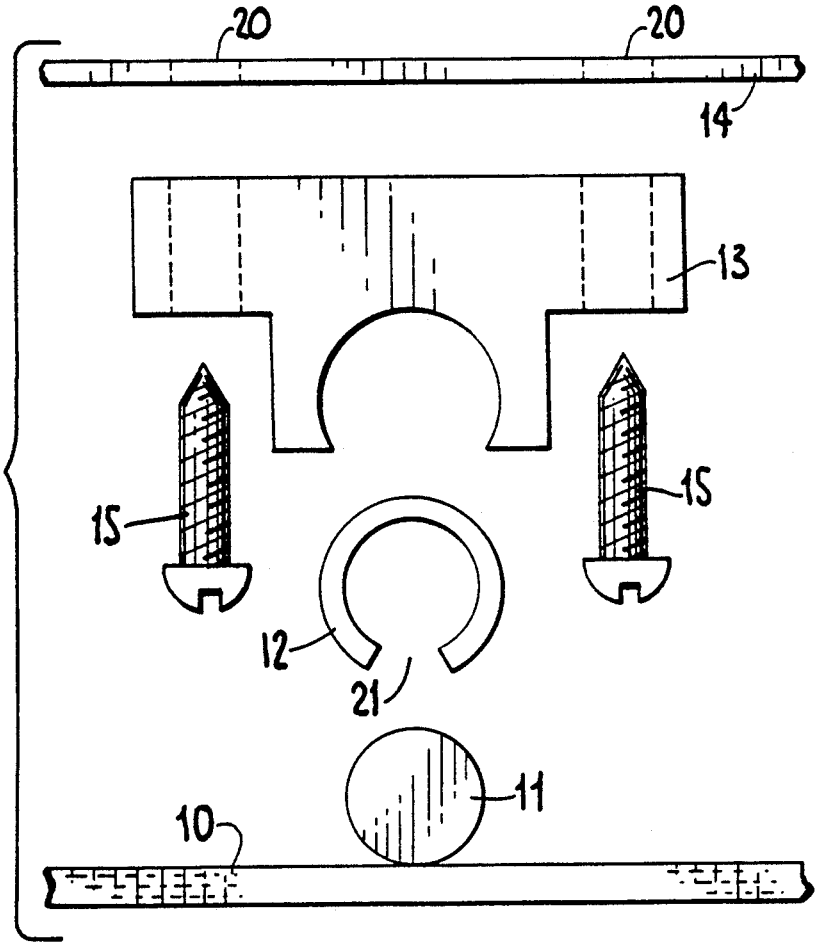
FIG. 2 is an exploded view of the invention showing the respective parts of a preferred embodiment.
Figure 3:
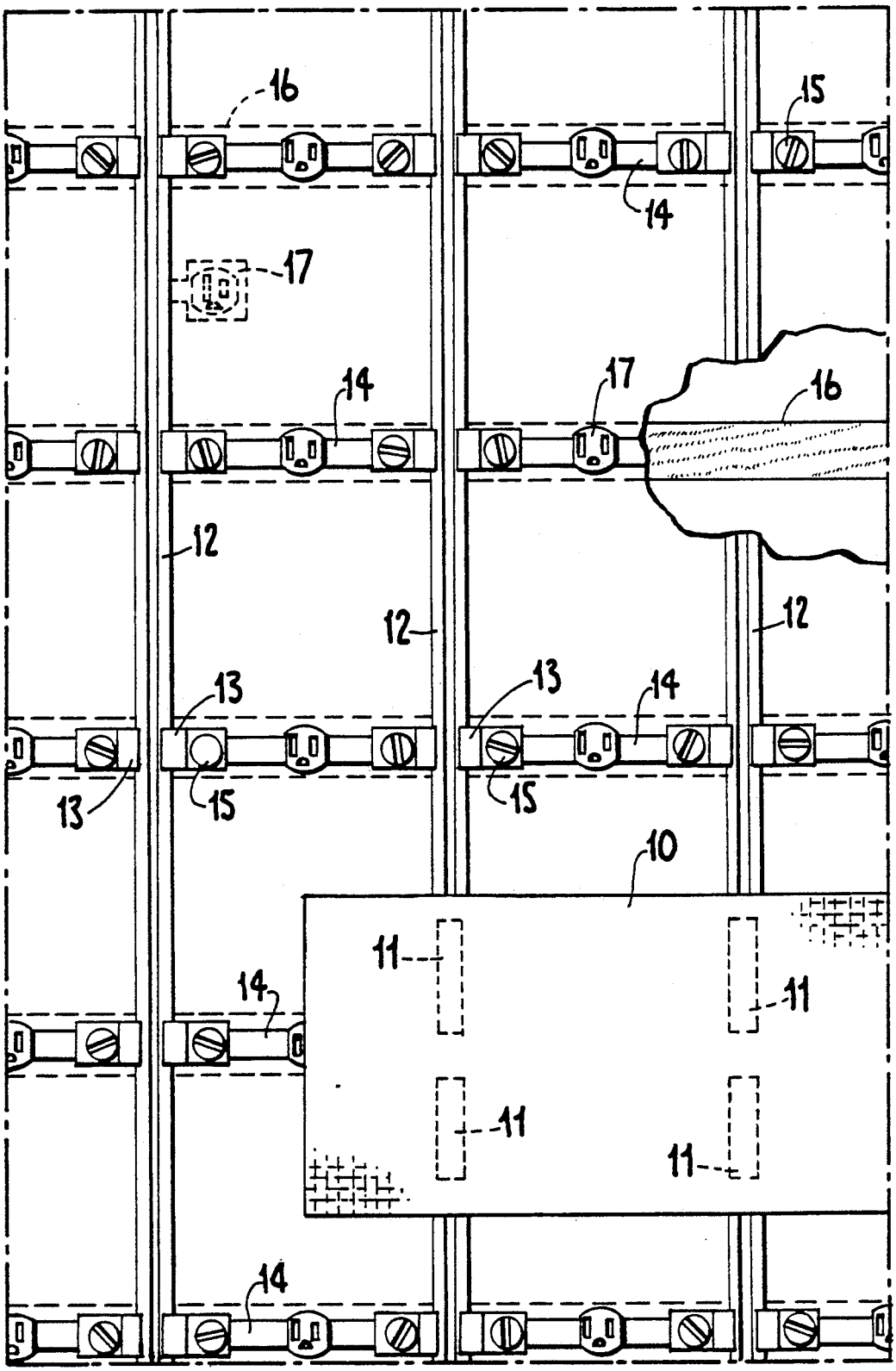
FIG. 3 is a bottom plan view of the assembled invention with one ceiling panel installed. A second embodiment is shown in dashed lines and a cutaway shows the location of the ceiling joists.
Figure 4:
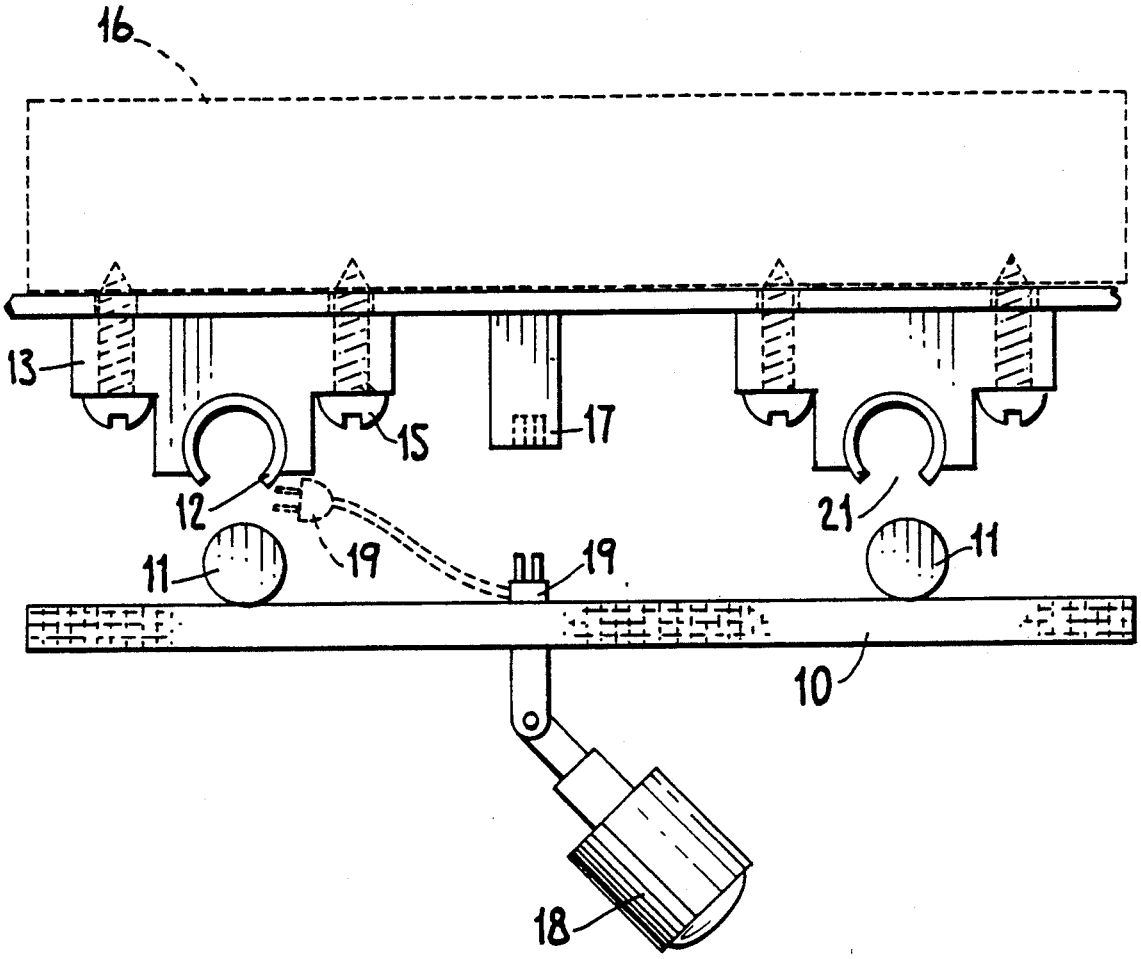
FIG. 4 is a side view of the invention with the ceiling joist shown in dashed lines and an electrical device of the preferred embodiment.

FIGS. 1 through 4 illustrate the basic components of the invention. A key component of the invention is slotted pipe 12. This pipe 12 defines a channel with a narrowed opening or slot leading to a somewhat larger interior, whereby the pipe will snap over and engage a lug having a diameter larger that the opening and small than, or equal to, the dimensions of the interior. Pipe 12 can be "C" shaped in section and preferably is made of a flexible resilient material which allows the opening in the "C" 21 to be spread to admit the lug. Alternatively the lug can be compressible or both the pipe and lug can be resilient. The pipe and/or lug should return to its original shape when the force used to engage the lug and pipe (e.g., to spread the opening in the "C" 21) is removed. A standard PVC pipe may be used as pipe 12 and may be slotted with any of the many techniques known in the art. Preferably pipe 12 is manufactured by extrusion so that the slotted or "C" shape is achieved in a one step manufacturing process. Pipe 12 is held to ceiling joists 16 by holding means 13 which, in the embodiment of FIGS. 1 to 4, are evenly spaced along the joists by using associated furring strips 14. Both the holding means and the furring strips are held to the ceiling joists with fastening means 15.

Lug 11 may extend continuously along the length of the panel 10 or may be shorter. The lug 11 is either roughly cylindrical or spherical in shape, complimenting pipe 12, and has a diameter approximating the internal diameter of pipe 12. The lug 11 is rigidly affixed to ceiling panel 10, for example being adhesively attached, bonded or formed integrally therein. When lug 11 is pressed against the opening of the "C" 21 in pipe 12, either the opening of the "C" 21 expands to allow the lug 11 to be inserted into pipe 12 or the lug 11 resiliently contracts, or both. This insertion is aided in a preferred embodiment where lug 11 is made of a deformable yet resilient material, for example polystyrene foam. The invention will also function with a rigid non-deformable lug is used. Once lug 11 is fully inserted into pipe 12, the pipe and/or lug resumes its original shape, thus engaging lug 11 in a manner rigid enough to support ceiling panel 10.

By pulling firmly downward on panel 10, pipe 12 and/or lug 11 will again deform to release lug 11 from pipe 12. In this way ceiling panel 10 may be "snapped" into and out of place. Thus, pressing a panel 10 upward with the lug 11 properly aligned over the opening in pipe 12 will result in a "snap" fit which will retain the ceiling panel and pulling downward on panel 10 will result in the "unsnapping" of the pipe 12 and lug 11 which free's the panel 10 for removal. Preferably each panel 10 has at least two lugs for engaging spaced pipes 12.

A spacing means 14 can be employed to keep the multiple holding means 13, which can be attached along each joist 16, precisely and properly distanced from one another without any measuring being needed on the part of the installer. Spacer or furring rail 14 is the spacing means of the preferred embodiment. The spacer rail 14 has holes 20 drilled at standard spacing, through which fastening means 15, which are screws for the preferred embodiment, will pass. The screws can fix the holding means 13 to the rail 14 only, whereupon the rail can be attached to the joist by any convenient fasteners, e.g., nails or screws, and the holding means need not align to the joist. Alternatively, screws passing through holding means 13 and rail 14, extending into the joist, can attach these parts all at once. The spacer rail 14 keeps the holding means 13 properly distanced from one another and properly aligned. Use of the spacing means 14 in connection with the holding means 13 allows for must faster setup than conventional "drop ceilings" as well as far fewer people. If desired for setting the ceiling height, additional spacing blocks or shims can be placed between rail 14 and the joist.

To install the invention, a spacer rail 14 is held in place on the bottom side of a joist, with any necessary spacers or shims interspersed. At every location where holes 20 appear in the rail 14, a holding means 13 is placed and fastened to one or both of the rail 14 and the joist 16 with screws 15 such that the holding means are correctly spaced and rigidly fixed relative to the joists. This process is repeated with every holding means and each ceiling joist 16 over the area to be covered by ceiling panels 10, being sure that the spacer rails 14 are aligned from a common reference point, for example a wall (not shown). Alignment is facilitated by placing one or more pipes 12 in the holding means 13 of rails installed first to thereby align those installed later. Thus the holding means 13 may be installed with the use of only a simple hand tool (not shown) without the need for extensive measuring and aligning of the parts.

Figure 5A:
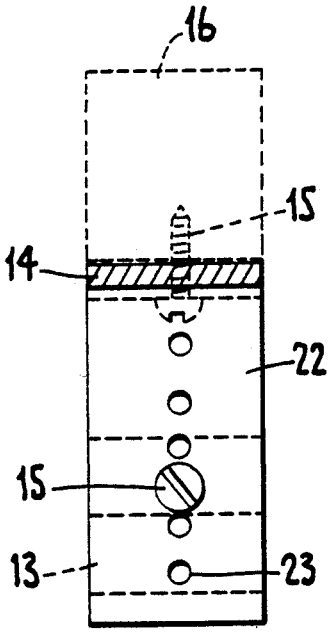
FIG. 5*a* is a side elevational view of a ceiling height adjusting means.
Figure 5B:
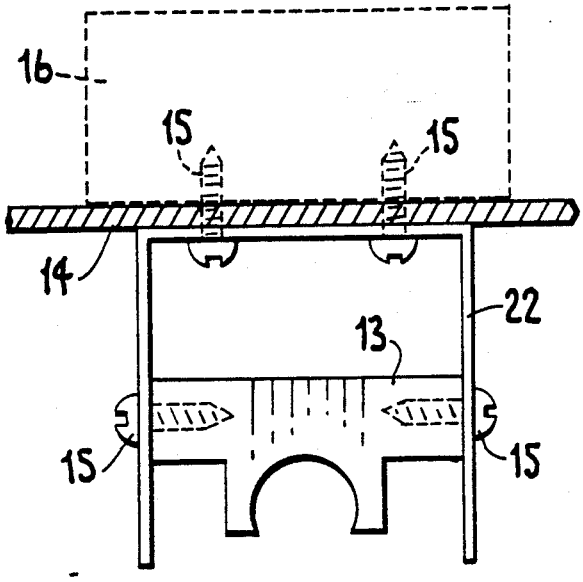
FIG. 5*b* is a front plan view of a ceiling height adjustment means.
Figure 5C:
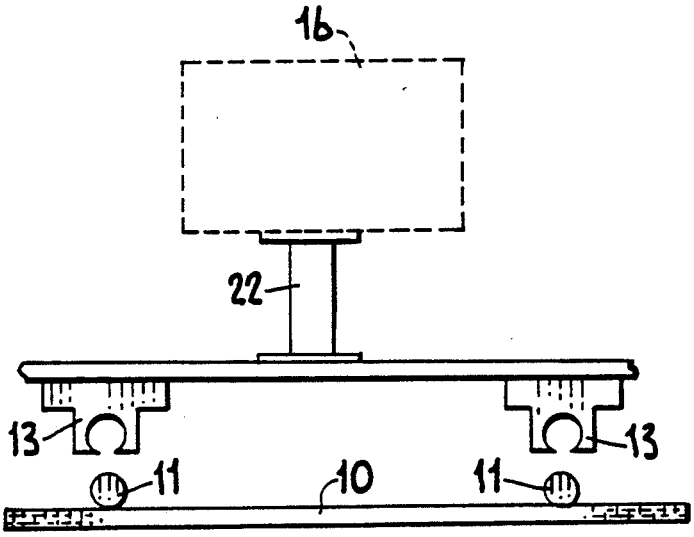
FIG. 5*c* is another height adjustment means

Pipes 12, running perpendicular to the joists and spacer rails, are then affixed to the holing means 13. The pipes 12 in the preferred embodiment snap into holding means 13, but other methods of affixing the parts may be used, for example clamps, screws, etc., provided opening 21 remains pointed downward and provided pipe 12 remains deformable as to accept lug 11 while securely keeping the pipes 12 in place. In this way the pipes 12 are secured to the joists 16 to form an array of parallel spaced receptacles for the lugs. The pipes 12 are necessarily held parallel to and equally spaced from one another by the holding means 13. The distance that the panels 10 will be positioned from the joists 16 may be determined, for example, by the height of the holding means 13 and the thickness of the spacer rail 14, or by an optional height adjustable attachment 22 referred to in FIGS. 5*a*, 5*b* and 5*c*. This height adjustable attachment 22, in the preferred embodiment, could also be referred to as a bracket 22 with multiple holes 23 drilled therethrough for attachment both to the joist 16 and to the holding means 13 at a variable height.

Once the ceiling height is set and the pipes 12 are mounted, all that remains of installation is the placing of the panels 10. Once the lugs 11 have been pressed into pipes 12 and the panel 10 is held overhead by the invention, the panels may be slid along the length of pipes 12 to allow a closer alignment with adjoining panels. Enough panels are added to cover the entire area. The panels can be of various interfitting shapes, not limited to rectangular shapes, for example to define a diagonally abutting edge or the like forming a herringbone pattern using parallelogram panels. If the panels are placed by upward force only (i.e., not slid along the pipes 12), then any complex shape of interfitting panels can be used. The illustrated rectangular shape is merely one example.

A preferred embodiment of the invention also includes an optional electrical power distribution system whereby electrical fixtures such as lamps, ceiling fans and the like can be placed and powered. Preferably the fixture panels can be relocated to any of a plurality of positions or even all of the positions. Electrical outlets 17, in this embodiment are associated with either spacer means 14 or the pipes 12 (shown in dashed lines in FIG. 3), and appropriate wiring connects to the AC mains or to a household switch and/or power supply (not shown) coupled thereto. The system can supply at least one outlet 17 at each panel location. The electrical system eliminates the need for special hard-wiring of any electrical devices 18 that are desired to be associated with the ceiling, for example lights, fans, speakers, and home security, smoke, and home protection sensors. Thus the panels 10 with the electrical devices affixed may be easily relocated to any location in the ceiling system for changes in decor, room layout, or seasonal changes, without rewiring. The male power connection 19 for the electrical device 18 may be set in such a manner that installation of panel 10 by upward pressure will automatically make an electrical connection between male power connection 19 and the female power outlet 17. In the alternative, the male power connection 19 (dotted lines) may be placed on a short cord 25 for connection to the female power outlet 17 just prior to installation of panel 10.

Figure 6A:
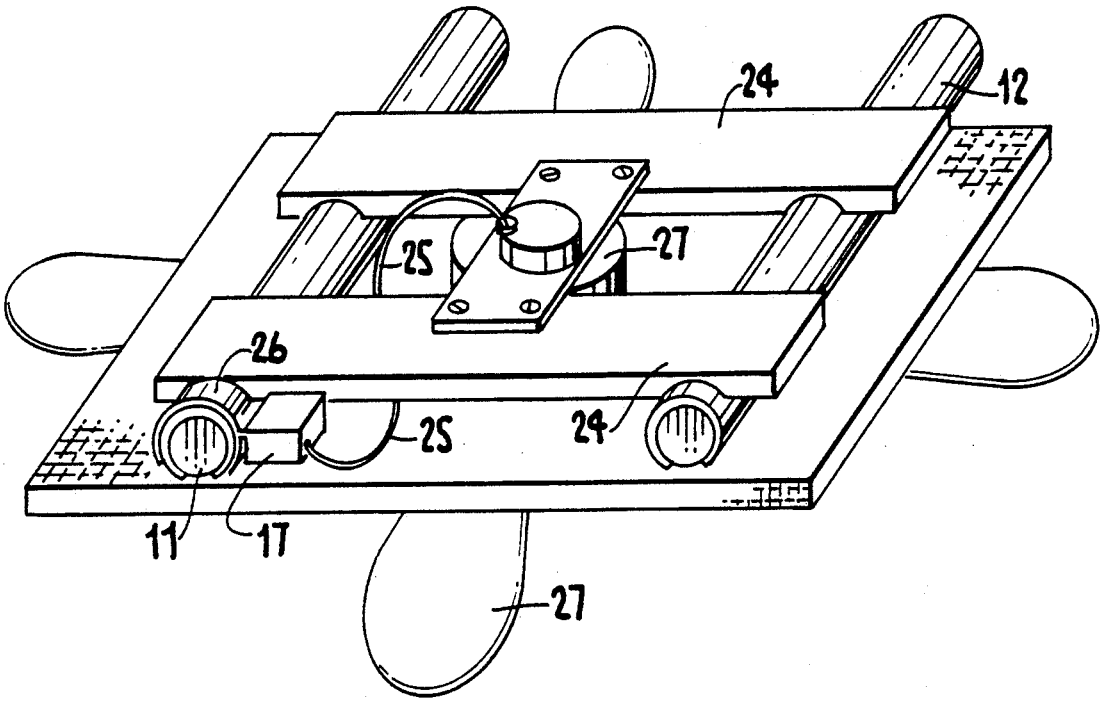
FIG. 6*a* is a perspective view of an electrical device (fan) mounted to a panel and the additional supports that are used.

Referring now to FIG. 6*a*, some electrical devices 18, for example fans 27, may be heavy enough to warrant support in addition to the lugs 11 inserted in the pipes 12. To provide this additional support one embodiment includes support planks 24 which rest on top of pipes 12 and which are affixed to part of the electrical device 18 which resides above the panel, for example the fan motor. Because these planks sit above the pipes, there is no danger of them being pulled downward, or falling downward accidentally.

Figure 6B:
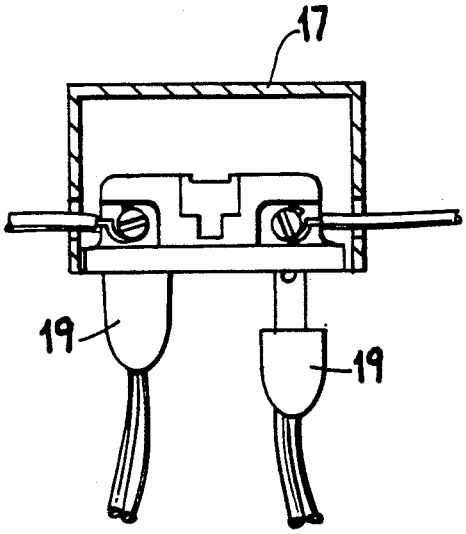
FIGS. 6*b* and 6*c* are side and end views in detail, of an electrical mount.
Figure 6C:
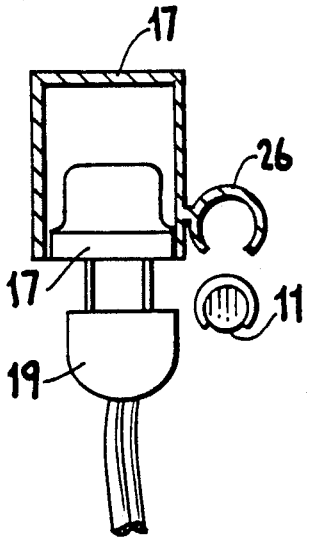

According to one embodiment, standard domestic power receptacle boxes 17 with standard electric sockets are strung in parallel connection along an electric wire. Each receptacle box is provided with a "U" shaped flange 26 on a side, the flange being dimensioned to snap over a pipe 12 from the tip, thus spacing the electric socket substantially in the plane of the top surface of panels 10. In this manner standard electric plugs disposed at a corresponding location on panels 10 simply push into attachment to the sockets as shown in FIGS. 6*b* and 6*c* when the panels 10 are installed.

In the preferred embodiment all elements of the invention, with the exception of the conductors of the electrical power distribution system and any metal fasteners, are made of non-conducting materials, for example plastic. This keeps manufacturing costs down, is resistant to damage caused by bending, denting or distorting during assembly, will not rust, mildew, or discolor over time due to excessive moisture or humidity, and adds an element of electrical safety. Should one of the conductors become exposed above the panels, there is no metal frame or parts to become charged conductors which could shock anyone doing maintenance on the ceiling. Furthermore, the plastic parts permit the ceiling as a whole to conform smoothly to minor irregularities in the alignment of the joists.

The present invention also allows for custom designed panel 10 shapes, sizes and electrical functions. Since there is no exposed frame, panels 10 can be made rectangular, triangular, rectilinear, saw-toothed, hourglass shaped, or any number of other shapes or combination of shapes which will fit together to form a completed ceiling. In addition, any color or finish may be chosen for the panels and this may be easily applied. There is no frame to paint or to color-match and the panels 10 may be finished at bench-top or floor level for ease. Nearly any chosen electrical device 18 may be attached to a ceiling panel 10 and may be located at any ceiling location giving further custom appearance to the ceiling as a whole.

While the foregoing description and drawings are indicative of the preferred embodiments of the present invention, attention is called to the fact that the drawings are illustrative only and that changes may be made in the specific construction illustrated and described with the scope of the appended claims.

What is claimed is:

1. A panel mounting construction, comprising:

a plurality of channels formed by slotted pipes defining in cross section a relatively smaller entrance opening at a slot to a relatively larger cavity;

means for holding the channels in parallel relationship on a mounting surface;

a plurality of panels, each of the panels having at least one projection dimensioned to engage resiliently through the entrance opening in the channels to reside securely in the cavity of the channels, at least one of the projection and the channels being resiliently deformable to receive the other of the projection and the channels, whereby the panels are removably mountable to the mounting surface on the channels.

2. The panel mounting construction of claim 1, wherein:

said channels have a "C" shaped cross section.

3. The panel mounting construction of claim 1, wherein:

said projections are at least one of elongated lugs and spherical lugs on rear faces of the panels.

4. The panel mounting construction of claim 4, wherein:

said lugs are constructed of foam plastic.

5. The panel mounting construction of claim 1, further comprising:

a plurality of rails with a plurality of regularly spaced means for receiving said holding means.

6. The panel mounting construction of claim 6, wherein:

said holding means are attached to said rails; and said rails are construction attachable to a plurality of at least one of joists and studs, whereby said holding means are properly positioned apart from position of said at least one of joists and studs.

7. The panel mounting construction of claim 1, wherein:

said mounting surface is a ceiling surface including any exposed joists.

8. The panel mounting construction of claim 1, wherein:

said mounting surface is a wall surface including any exposed studs.

9. The panel mounting construction of claim 1, wherein:

said channels are constructed of PVC.

10. The panel mounting construction of claim 5, further comprising:

a plurality of electrical outlets affixed adjacent to at least one of said channels and said rails.

11. The panel mounting construction of claim 10, wherein:

said electrical outlets are provided regularly throughout the construction.

12. The panel mounting construction of claim 11, wherein:

at least one said electrical outlet is provided for each said panel.

13. The panel mounting construction of claim 1, wherein:

said panels are shaped as at least one of rectangular, triangular, rectilinear, saw-toothed, and hourglass shaped;

whereby a variety of patterns may be made into the panel mounting construction.

14. A panel mounting construction, comprising:

a plurality of channels defining in cross section a relatively smaller entrance opening to a relatively larger cavity;

means for holding the channels in parallel relationship on a mounting surface;

a plurality of panels, each of the panels having at least one projection dimensioned to engage resiliently through the entrance opening in the channels to reside securely in the cavity of the channels, at least one of the projection and the channels being resiliently deformable to receive the other of the projection and the channels;

a plurality of rails with a plurality of regularly spaced means for receiving said means for holding the channels;

a plurality of electrical outlets affixed adjacent to at least one of said channels and said rails; and, at least one electrically operated device attached to at least one said panel;

whereby said at least one panel associated with at least one electrically operated device may be relocated or removed easily and conveniently.

15. The panel mounting construction of claim 14, further comprising:

a plurality of modular receptacles which provide an electrical connection for said at least one electrically operated device when a plug and socket are aligned prior to installation of said panel, whereby installing said panel with said electrical device attached will achieve said electrical connection.

16. The panel mounting construction of claim 14, wherein:

said electrically operated device comprises at least one of a fan, a lighting fixture, a loudspeaker, and a home security sensor.

17. The panel mounting construction of claim 14, further comprising:

means of extra support for said electrically operated devices;

said extra supporting means transferring a load of a mass of the said device to a side of the said channels opposite from the entrance opening;

whereby the device and the attached panel cannot accidentally pull free of the channel.

18. A panel mounting construction, comprising:

a plurality of channels defining in cross section a relatively smaller entrance opening to a relatively larger cavity;

means for holding the channels in parallel relationship on a mounting surface;

a plurality of panels, each of the panels having at least one projection dimensioned to engage resiliently through the entrance opening in the channels to reside securely in the cavity of the channels, at least one of the projection and the channels being resiliently deformable to receive the other of the projection and the channels; and, means for adjusting a distance said holding means is set from said mounting surface;

whereby the ceiling panels may be mounted to a specified distance from said mounting surface.

19. A method of installing a panel mounting construction, comprising:

providing a plurality of channels defining in cross-section a relatively smaller entrance opening to a relatively larger cavity;

affixing said channels to a mounting surface with said channels being parallel to and evenly spaced from one another and with the opening to each said channel pointing away from said surface;

providing a plurality of panels, each having at least one projection dimensioned to engage resiliently through the entrance opening in the channels to reside securely in the cavity of the channels, at least one of the projection and the channels being resiliently deformable to receive the other of the projection and the channels;

inserting said at least one projection from each said panel into said entrance opening thus securing each said panel into place overhead;

sliding each said panel in the direction of the parallel pipes so that it abuts an adjacent panel;

removing said panels by pulling to release the projections from the channels;

at least one of cleaning, relocating, refinishing and replacing said panels with other said panels; and, inserting said at least one projection of said panels to again secure the panels in place.

20. The method of installing a suspended ceiling construction of claim 19 further comprising:

providing a plurality of electrical outlets evenly spaced throughout the panel mounting construction;

providing a plurality of electrical device associated panels; and replacing a plurality of said ceiling panels with said electrical device associated panels; and connecting said electrical device associated panels to the at least one electrical outlet.

* * * * *

UNITED STATES PATENT AND TRADEMARK OFFICE

CERTIFICATE OF CORRECTION

PATENT NO. : 5,056,287

DATED : October 15, 1991

INVENTOR(S) : Michael Weber

It is certified that error appears in the above-identified patent and that said Letters Patent is hereby corrected as shown below:

Col. 7, Claim 4, line 44, delete "4" and insert therefor --3--.

Col. 7, Claim 6, line 51, delete "6" and insert therefor --5--.

Signed and Sealed this

Nineteenth Day of January, 1993

*Attest:*

DOUGLAS B. COMER

*Attesting Officer*

*Acting Commissioner of Patents and Trademarks*